United States Patent [19]

Smith

[11] 3,955,685

[45] May 11, 1976

[54] APPARATUS FOR LINING A FURNACE

[75] Inventor: Joe H. Smith, Bluff Park, Ala.

[73] Assignee: United States Steel Corporation, Pittsburgh, Pa.

[22] Filed: Feb. 15, 1974

[21] Appl. No.: 442,710

Related U.S. Application Data

[62] Division of Ser. No. 253,217, May 15, 1972, Pat. No. 3,853,204.

[52] U.S. Cl. ..... 214/1 H; 182/142; 182/128; 214/95 R; 214/670; 198/81; 198/66

[51] Int. Cl.[2] ..... E04G 3/14

[58] Field of Search ..... 182/128, 142, 152, 129, 182/130, 131, 132; 52/741, 747; 214/1 H, 95, 670; 198/66, 81

[56] References Cited

UNITED STATES PATENTS

| | | | |
|---|---|---|---|
| 2,933,918 | 4/1960 | Arnold | 182/128 |
| 3,033,389 | 5/1962 | Abarotin | 182/128 |
| 3,166,154 | 1/1965 | Titzel | 182/128 |
| 3,241,634 | 3/1966 | Prosser | 182/128 |
| 3,370,888 | 2/1968 | Skendrovic | 182/128 |
| 3,439,794 | 4/1969 | Park et al. | 182/128 |

*Primary Examiner*—Reinaldo P. Machado

[57] ABSTRACT

Apparatus as described for lining the interior of a metallurgical furnace, especially one having openings at both the bottom and the top of the vessel, with refractory brick. A tower structure is extensible into the furnace interior and carries a work platform that is positionable to various elevations within the furnace.

35 Claims, 15 Drawing Figures

APPARATUS FOR LINING A FURNACE

This is a division, of application Ser. No. 253,217, filed May 15, 1972, now U.S. Pat. No. 3,853,204.

BACKGROUND OF THE INVENTION

A quality basic oxygen process (Q-BOP) furnace utilizes a bottom blown oxygen process developed recently in West Germany and in the United States. Q-BOP is a trade name of Eisenwerk-Gesellschaft Maximilianshutte GmbH (Maxhutte) of West Germany and the assignee of the present invention. The Q-BOP furnace utilizes a method of processing steel in which molten iron and other metallics are charged into the furnace. Oxygen, enveloped in a protective fluid stream, is blown through a tuyere or tuyeres located in the bottom of the furnace. Powdered lime, or other furnace additions together with the oxygen are blown through the tuyere while a protective fluid, which can be natural gas, propane, fuel oil or the like, envelops the oxygen and acts as a coolant to increase both the life of the bottom of the tuyere and the furnace bottom.

The tuyere or tuyeres in the bottom of a Q-BOP furnace are contained in a removable plug in the bottom of the furnace, which plug is removed therefrom by means of an apparatus of the type shown in U.S. Pat. No. 3,388,501 issued June 18, 1968, to Puhringer et al. After the bottom plug has been removed, the Q-BOP furnace is relined with a refractory material by the apparatus for and method of lining such furnaces herein disclosed.

I am aware of the following U.S. Patents relating to apparatus for and methods of lining furnaces.

| U.S. Patent No. | Inventor | Class | Issued |
|---|---|---|---|
| 3,033,389 | Abarotin et al | 214/1 | 5/ 8/62 |
| 3,439,794 | Park et al | 198/83 | 4/22/69 |
| 3,601,245 | Monroe | 198/101 | 8/24/71 |
| 2,346,033 | Jordan | 304/12 | 4/ 4/44 |
| 3,236,397 | Lakin | 214/1 | 2/22/66 |
| 3,241,634 | Prosser | 182/144 | 3/22/66 |
| 3,285,390 | Puxkandl et al | 198/103 | 11/15/66 |
| 3,388,501 | Puhringer et al | 49/324 | 6/18/68 |
| 3,256,956 | Puhringer | 182/128 | 6/21/66 |
| 3,259,208 | Behr | 182/128 | 7/ 5/66 |
| 3,298,154 | Behr et al | 52/749 | 1/17/67 |
| 3,517,771 | Mahringer et al | 182/128 | 6/30/70 |

Puhringer U.S. Pat. No. 3,256,956

As shown in FIGS. 3–7, a carriage 20 aligns the frame 6 (carrying the first scaffold element 12) with the opening in the bottom ring plate 2 (FIG. 3). The frame 6 is raised adjacent to and attached to the flange 4 of the lower part 3 of crucible 1 (FIG. 4). The platform 18 on element 12 swings out (FIG. 5). In FIG. 6, the second tubular element 13 is attached by key and slot to the first tubular element 12.

The elevating of the elements 12, 13 is accomplished by rack 11 on towers 12, 13 and pinion 14, 14' on collar 6 and the material by the winch 16 and rope 17 (FIG. 1).

Behr U.S. Pat. No. 3,259,208

A main telescoping piston 10 raises the main (expandable) work platform 8 through the opening 3 in the converter 1. Bricks are fed through passage 9 (FIG. 5) in platform 8. An auxiliary work platform 6 is mounted on supports 7 upstanding from main platform 8, has a brick opening 12 (FIG. 6) and is used to line the top portion 11 of the converter 1 (FIG. 6).

Behr et al. U.S. Pat. No. 3,298,154

A working stage 1 is inserted into the converter 2, carries a rotatable turntable 3 rotatable on balls 4 and has a block opening 12 which registers with a like opening in the turntable 3 to permit the elevator 4 to deliver a stone 14 onto a first carriage movable on rails 5 on the turntable 3. A lifting device 8 is mounted on a second carriage 7 movable on rails 6' on the first carriage 6.

The apparatus moves the stone 14 from the position shown in FIG. 1 to the "in-place" position shown in FIG. 2.

Mahringer et al. U.S. Pat. No. 3,517,771

A support platform 50 has a travel frame 2 movable on wheels 4 on the ground 5 (FIG. 1) so that a work platform 7 can be inserted into the converter 1 and elevated on telescoping lift rods 8, 9, 10, inner guides 8', 9', 10', (supported by brackets 15, 16, 17 on top wall of the work platform 50) and lower guides 12, 13, 14. An elevator 23 reciprocates by its rollers 25, 26 on telescoping outer guides 19, 20, inner guides 19', 20' and lower guides 21, 22 (FIG. 1) and through opening 27 in work platform 7 (FIG. 2). A collapsible winch 28 on work platform 7 operates the elevator 22.

OBJECTS OF THE INVENTION

It is the general object of this invention to avoid and overcome the foregoing and other difficulties of and objections to prior art practices by the provision of an improved apparatus for and methods of lining a furnace, which apparatus and methods are:

a. simple and rugged in construction;
b. capable of a long maintenance-free operational life;
c. are efficient and economical in operation; and
d. reduce the normal down time of the furnace due to relining the inner lining thereof with a refractory material.

BRIEF SUMMARY OF THE INVENTION

The aforesaid objects of this invention and other objects which will become apparent as the description proceeds are achieved by providing improved apparatus for and methods of lining a furnace, provided with a bottom aperture in the furnace bottom, with an inner lining of a refractory material.

I. The preferred embodiment of the apparatus has a support member secured to the furnace in registry with the bottom aperture for guiding the apparatus through the bottom aperture and such support member is provided with a tower aperture. A first tower is adapted to pass through the tower aperture in the support member and is provided with a refractory material aperture. Tower elevating means are on one member of the support member and the first tower, are connected to the other member of the support member and the first tower, and are operable to raise the first tower through the tower aperture in the support member. A turntable is rotatable on the top of the first tower and is provided with a second refractory material aperture in registry with the refractory material aperture in the first tower. A work platform is mounted on the turntable, which work platform is provided with a third refractory material aperture, and is movable on the turntable from a storage position on the turntable where the work platform passes through the tower aperture in the support member, to a work position where the work platform extends beyond the turntable to enable a workman to stand on the work platform. Refractory material elevating means are mounted on the work platform, are engageable with the refractory material, and are operable to raise the refractory material through the refractory material aperture in the first tower, the second refractory material aperture in the turntable, and the third refractory material aperture in the work platform into alignment with the work platform so that the refractory material can be transferred to the work platform.

II. An alternative embodiment of the apparatus has a table support member secured to the furnace adjacent a top aperture of the furnace. The turntable is rotatable on the table support member and is provided with work platform elevating means clearance apertures. The work platform is movable through the bottom aperture in the furnace while it is in the storage position and is then further movable from the storage position to a work position where a workman may stand on the work platform. The work platform is provided with a refractory material aperture. Work platform elevating means are on one member of the turntable and the work platform, extend through the table support member, and are connected to the other member of the turntable and the work platform for moving the work platform through the bottom aperture in the furnace to a desired work position within the furnace. Refractory material elevating means extend through the table support member and are connectable to the refractory material for moving the refractory material through the refractory material aperture in the work platform so that the refractory material can be transferred from the refractory material elevating means to the work platform.

III. The preferred method of lining a furnace includes the steps of:

a. securing a support member to the bottom of the furnace in registry with a bottom aperture in the furnace;

b. moving a work platform mounted on a turntable, which turntable is rotatable on the top of the first tower, through a tower aperture in the support member to a desired work position within the furnace;

c. moving the work platform from a storage position on the turntable, where the work platform passes through the tower aperture in the support member, to a work position where the work platform extends beyond the turntable to enable a workman to stand on the work platform;

d. elevating the refractory material through a refractory material aperture in the first tower, a second refractory material aperture in the turntable and a third refractory material aperture in the work platform into alignment with the work platform so that refractory material can be transferred to the work platform;

e. transferring the refractory material to the work platform;

f. rotating the turntable and the work platform to align the work platform with an inner portion of the furnace where the inner lining of the refractory material is to be applied; and g. applying the refractory material to the inner portion of the furnace.

IV. An alternative method of lining the furnace includes the steps of:

a. securing a table support member to the furnace adjacent a top aperture in the furnace;

b. moving the work platform through a bottom aperture in the furnace to a work position within the furnace;

c. moving the work platform from a storage position where the work platform passes through the bottom aperture in the furnace to a work position where a workman is able to stand on the work platform;

d. moving the refractory material through a refractory material aperture in the work platform to align the refractory material with the work platform so that the refractory material can be transferred to the work platform;

e. transferring the refractory material to the work platform;

f. rotating the work platform and the turntable on the table support member to align the work platform with an inner portion of the furnace where the inner lining of the refractory material is to be applied; and g. applying refractory material to the inner portion of the furnace.

BRIEF DESCRIPTION OF THE SEVERAL VIEWS OF THE DRAWINGS

For a better understanding of this invention, reference should be had to the accompanying drawings wherein like numerals of reference indicate similar parts throughout the several views and wherein:

FIG. 10 is a diagrammatic wiring diagram showing the controls for operating the motors for the turntable, for the tower elevating means, for a first hoist for operating the refractory material elevating means, for an auxiliary or second hoist affixed to the building framework above the top aperture of the furnace; and for an indexing motor for alternatively indexing the turntable of the apparatus and the like;

Although the principles of this invention are broadly applicable to apparatus for and methods of lining a crucible or converter type furnace, this invention is adapted for use in conjunction with a Q-BOP type furnace, and hence it has been so illustrated and will be so described.

DETAILED DESCRIPTION

Figure 1:
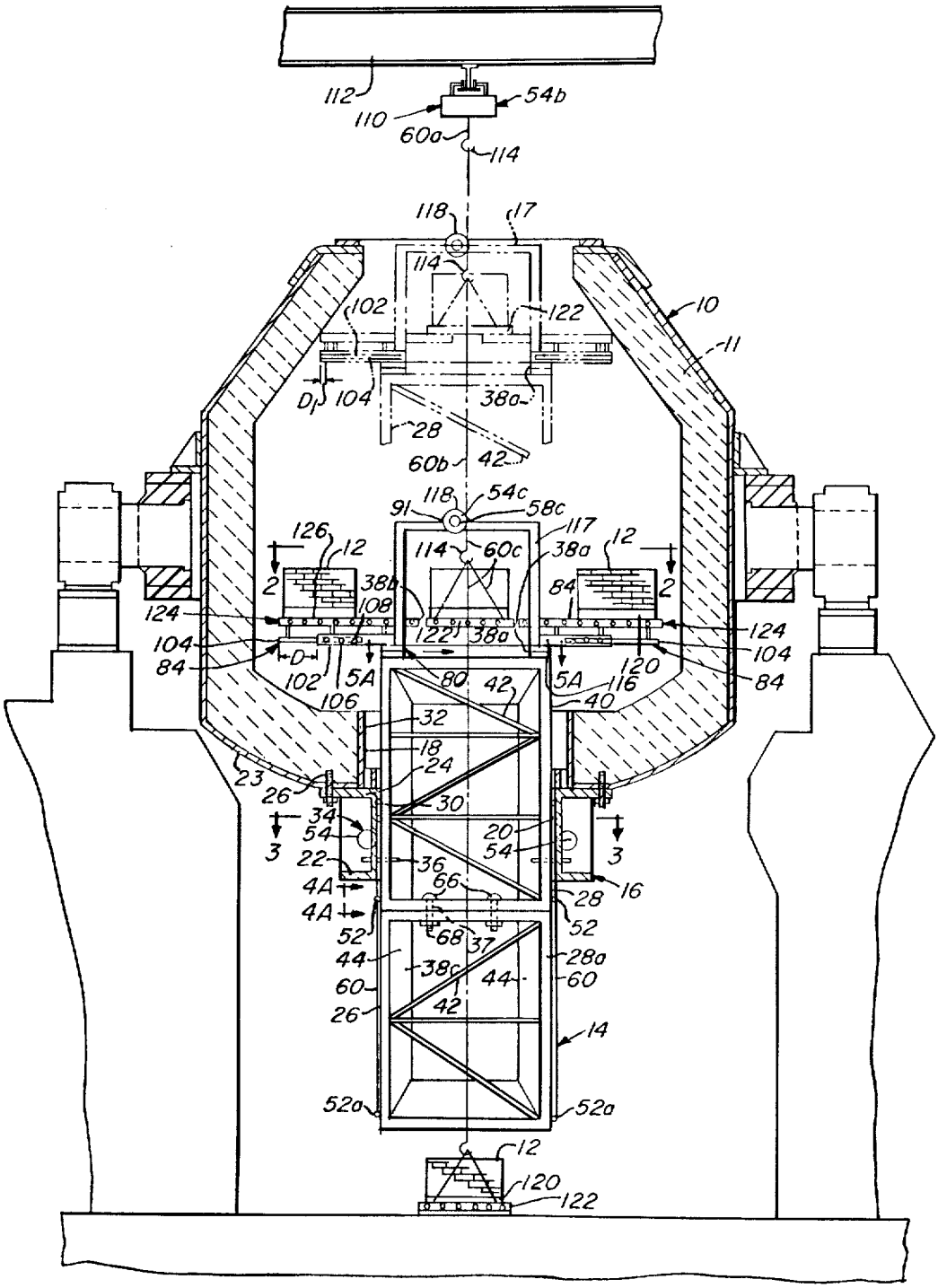
FIG. 1 is a diagrammatic side elevational view partially in section of a preferred embodiment of the apparatus for lining a furnace and showing the furnace provided with a bottom aperture, a support member secured to the furnace in registry with the bottom aperture for guiding the apparatus through such bottom aperture and provided with a tower aperture; a first tower adapted to fit through a tower aperture in the support member and provided with a refractory material aperture, a tower elevating means on the support member and connected to the first tower and operable to raise the first tower through the tower aperture in the support member; a turntable rotatable on the top of the first tower and provided with a second refractory material aperture in registry with the refractory material aperture in the first tower; work platforms mounted on the turntable, each of which work platforms is provided with a third refractory material aperture, and is movable on the turntable from a storage position on the turntable where the work platform passes through the tower aperture in the support member, to a work position where the work platform extends beyond the turntable to enable a workman to stand on the work platform; and refractory material elevating means mounted on the work platforms, engageable with the refractory material and operable to raise the refractory material through the refractory material aperture in the first tower, the second refractory material aperture in the turntable and the third refractory material aperture in the work platforms into alignment with the work platforms so that the refractory material can be transferred to one of the work platforms.

With specific reference to the form of this invention illustrated in the drawings and referring particularly to FIG. 1, an apparatus for lining a furnace 10 (of the Q-BOP type) with an inner lining 11 (FIG. 1) of a refractory material 12, such as refractory brick or the like, is indicated generally by the reference numeral 14 (FIG. 1).

Apparatus 14 (FIGS. 1–6, 10)

Figure 2:
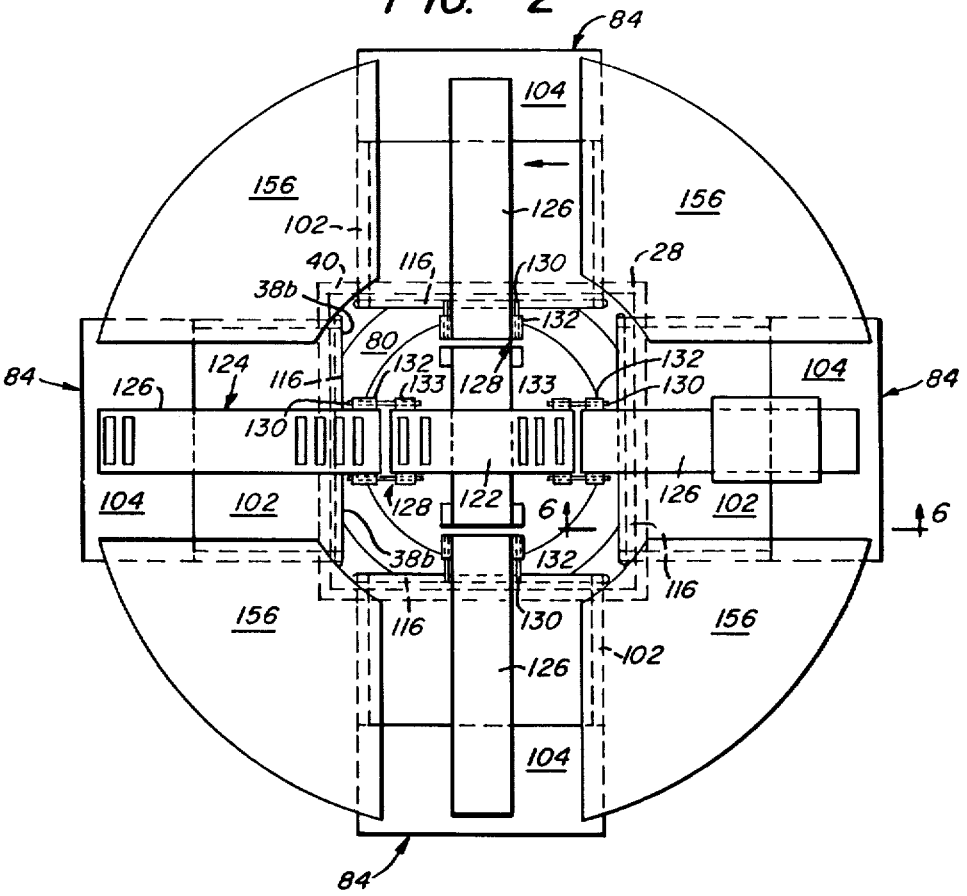
FIG. 2 is a horizontal sectional view taken along the line 2—2 of FIG. 1 in the direction of the arrows and showing the work platforms mounted on the first tower, the refractory material supported by a pallet, which pallet in turn is carried by a conveyor section, the conveyor section in alignment with a conveyor means on the work platform and secured to the conveyor means by locking means and showing also the work platforms in the extended work position.
Figure 3:
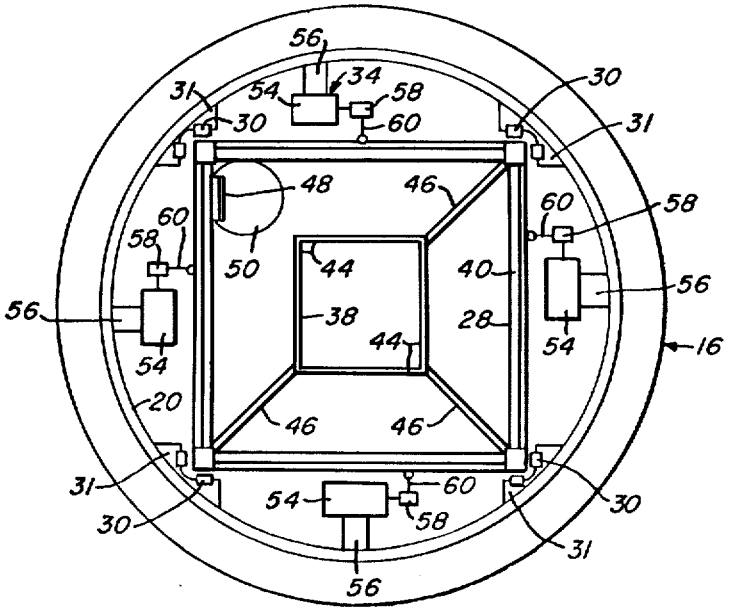
FIG. 3 is a horizontal sectional view taken along the line 3—3 of FIG. 1 in the direction of the arrows and showing a cross section of the first tower, the tower elevating means for raising the first tower, the pallet guide means mounted on the inside of the first tower, the tower roller guide means mounted on the support member and a ladder mounted in one corner of the interior of the first tower and surrounded by a ladder cage.

The apparatus 14 (FIGS. 1–6, 10) has a support member 16 (FIGS. 1, 3) secured to the furnace 10 in registry with a bottom aperture 18 (FIG. 1) for guiding the apparatus 14 through such bottom aperture 18 in the furnace 10. Such support member 16 is also provided with a tower aperture 20 (FIGS. 1–3).

Support Member 16

This support member or collar 16 has a lower flanged ring portion 22 (FIG. 1), which portion 22 is secured through its upper flange 24 (FIG. 1) to the bottom portions of the shell 23 (FIG. 1) of the furnace 10 as by a plurality of bolts 26 (FIG. 1). For the purpose of guiding the path of movement of a first tower 28 (FIGS. 1–3) through the tower aperture 20 in the support member 16, the support member 16 is provided with a plurality of tower guide rollers 30 (FIGS. 1 and 3) mounted on the support member 16 by brackets 31 (FIG. 3). The means utilized to define the end of the refractory lining 11 on the bottom of the furnace 10 adjacent the bottom aperture 18 in the furnace 10 is a form means, such as a form ring 32 (FIG. 1) or the like, projecting upwardly from the upper flange 24 of the support member 16. As shown in FIGS. 1 and 3, a tower elevating means 34 (FIGS. 1, 3, 4A, 4B) is mounted on the support member 16 and such support member 16 and first tower 28 are provided with registering tower locking apertures 36 (FIG. 1) for use in securing the first tower 28 to the support member or collar 16 when a second tower 28*a* (FIG. 1) is secured to the first tower 28 and the tower elevating means 34 is disconnected from the first tower 28 and connected to the second tower 28*a* as hereafter explained.

The First Tower 28 (FIGS. 1–3, 5A, 5B)

This first tower 28 (FIGS. 1–3, 5A, 5B) is, of course, adapted to pass through the tower aperture 20 in the support collar 16. Such first tower 28 is provided with a refractory material aperture 38 (FIG. 3). As shown in FIGS. 1–3, such first tower 28 is a generally open-ended box-like structure having an outer frame 40 (FIGS. 1–3), suitably formed of angles secured together as by welding or the like, and is provided with a plurality of intersecting horizontal and generally zig-zag plate members 42 (FIG. 1) for reinforcing each generally open face of the frame 40. The means utilized to define the refractory material aperture 38 in the first tower 28, shown particularly in FIGS. 1 and 3, comprises a plurality of guides 44 (FIGS. 1, 3) which guides 44 form a generally rectangular or square cross section to provide the refractory material aperture 38 and a plurality of three supporting plates 46 (FIG. 3) extending as shown in FIG. 3, from three corners of the guides 44 to adjacent corners of the outer frame 40 of the first tower 28. For the purpose of permitting guarded access to the interior of the first tower 28, a ladder 46 (FIG. 3) is secured as by welding or the like, to the left hand end side of the outer frame 40 of the first tower 28 and such ladder 46 is surrounded by a ladder cage 50 (FIG. 3).

Figure 4A:
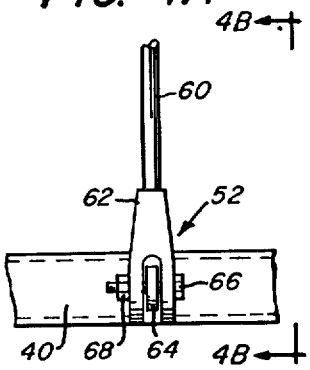
FIG. 4A is a fragmentary vertical sectional view taken along the line 4A—4A of FIG. 1 in the direction of the arrows and showing the connecting means between the frame of the first tower and the cable of the first tower elevating means.
Figure 4B:
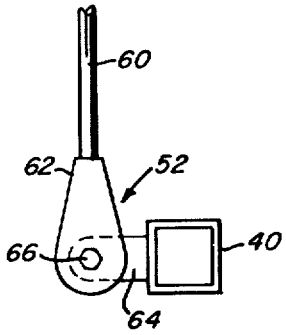
FIG. 4B is a fragmentary side elevational view taken along the line 4B—4B of FIG. 4A in the direction of the arrows.

Such first tower 28 is secured to the tower elevating means 34 at 52 (FIGS. 1, 4A, 4B).

Tower Elevating Means 34 (FIGS. 1, 3, 4A, 4B)

Such tower elevating means 34, best shown in FIGS. 1 and 3, has a plurality of motors 54 (in this case, four, FIGS. 1, 3) mounted on brackets 56 (FIG. 3) secured to the support member or collar 16. Such hoists 54 each drive an individual drum 58 (FIG. 3) from which a cable 60 (FIGS. 3, 4A, 4B) depends and is connected as shown in FIGS. 4A and 4B at the connection point 52 by means of a clevis or the like 62 (FIGS. 4A, 4B) secured on the end of the table 60, as by welding or the like. Such clevis 62 is secured to a lug 64 (FIGS. 4A, 4B) extending from the tower frame 40 of the tower 28 by means of a bolt 66 and nut 68.

Figure 10:
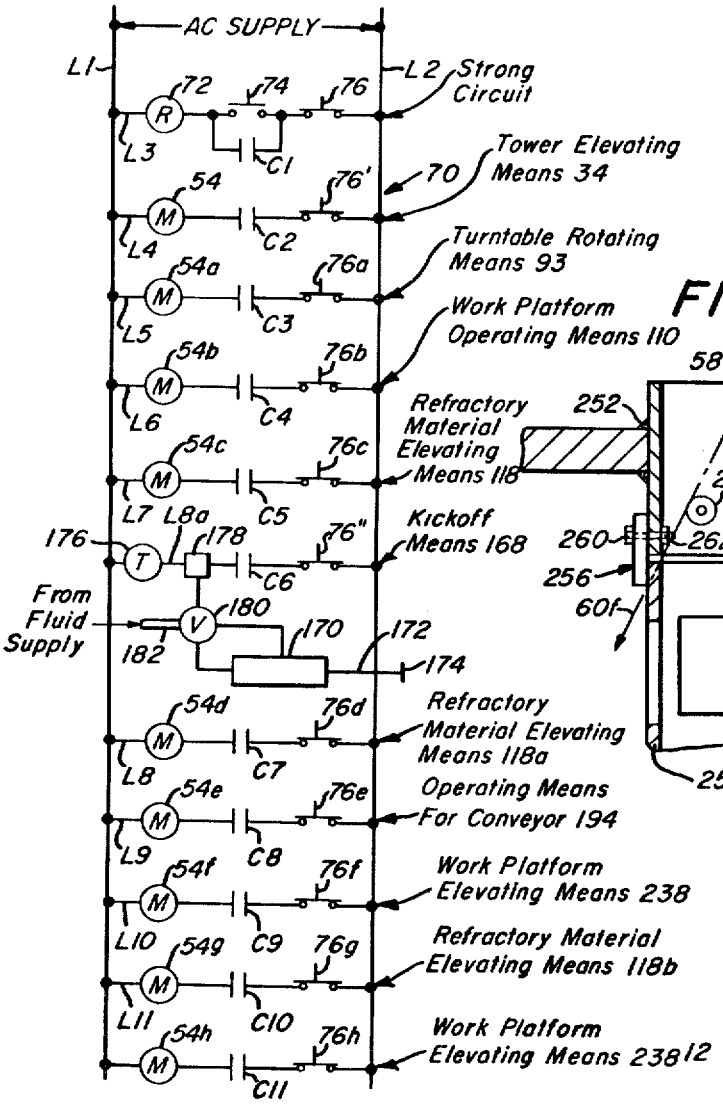

The control means 70 for operating the tower elevating means 34 and other operating means hereinafter described is shown in FIG. 10.

Control Means 70 (FIG. 10)

This control means 70 (FIG. 10) has a pair of lines L1 and L2 extending from a suitable source of voltage indicated in FIG. 10 by the legend "AC Supply" to a branch line L3 extending through a relay 72, a normally open manually operated starting switch 74 and a normally closed manually operated stop switch 76. The holding means utilized to maintain energization of the circuit through lines L1, L2 is a normally open holding contact C1 disposed in parallel about the normally open manually operated starting switch 74 so that when such starting switch 74 is manually closed, the relay 72 is energized and the normally open holding contact C1 is closed, thereby maintaining a closed circuit through the relay 72 from the AC source of supply.

Simultaneously therewith upon energization of the relay 72, the drive motor 54 for each of the hoists of the tower elevating means 34 are energized by closure of a second normally open holding contact C2 of the now energized relay 72 by the connecting line L4 which is disposed in parallel between the suppply lines L1 and L2 with respect to the branch line L3. The means utilized to deenergize the drive motors 54 for the hoists of the tower elevating means 34 and the hoists 54 themselves is, of course, the manually operated normally closed stop switch 76 which upon manual opening thereof deenergizes the control means 70 for the hoist motors 78 of the tower elevating means 34.

It will be understood that a manually operated normally closed stop switch 76 can be installed in the line L4 to deenergize the hoist motors 54 for the tower elevating means 34 without deenergizing the relay 72.

A turntable 80 (FIGS. 1, 2, 5A, 5B) is mounted on the top of the first tower 28 (FIG. 1) and is rotatable continuously at about 30 rpm on such tower 28 or indexable with respect to the tower 28.

Turntable 80 (FIGS. 1, 2, 5A, 5B)

This turntable 80 (FIGS. 1, 2, 5A, 5B) is provided with a second refractory material aperture 38*a* (FIGS. 1, 5A, 5B) disposed in registry with the refractory material aperture 38 in the first tower 28. The turntable 80, shown particularly in FIGS. 1, 5A and 5B, is rotatable on the top of the first tower 28 by means of a thrust bearing 82 (FIG. 5B) disposed between the tower frame 40 of the first tower 28 and work platforms 84 (FIGS. 1, 2, 5B).

Figure 5A:
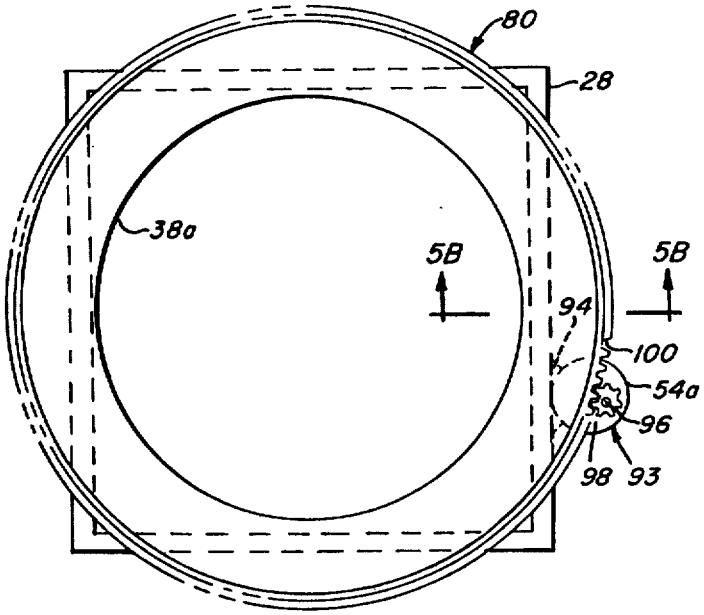
FIG. 5A is a horizontal sectional view taken along the line 5A—5A of FIG. 1 in the direction of the arrows and showing diagrammatically the turntable rotatable upon the first tower, and the drive means for rotating continuously the turntable at a speed of about 30 rpm.
Figure 5B:
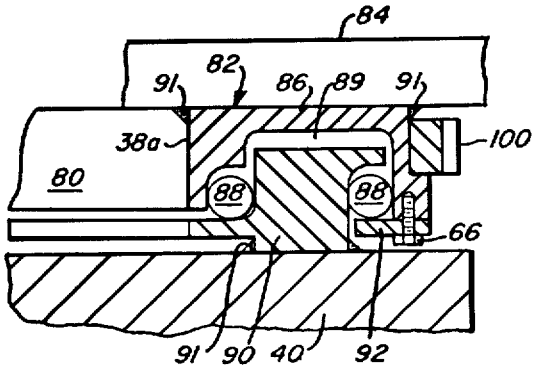
FIG. 5B is a vertical sectional view taken along the line 5B—5B of FIG. 5A in the direction of the arrows and showing the thrust bearing between the turntable and the first tower, which thrust bearing takes thrust in a vertical and horizontal direction.

This thrust bearing 82 shown particularly in FIGS. 5A and 5B takes thrust during the operation of the apparatus 14 in both a vertical and horizontal direction. Such thrust bearing 82 has an upper portion 86 (FIG. 5B) on the turntable 80 adapted to receive a plurality of roller bearings 88 (FIG. 5B) in a cavity 89 (FIG. 5B) defined by the upper portion 86 and a lower portion 90 (FIG. 5B) of the thrust bearing 82 upstanding from the tower frame 40 of the first tower 28 (FIG. 5B) and secured to the first tower 28 as by welds 91 (FIG. 5B) or the like. After the ball bearings 88 have been inserted into the cavity 89, a removable ring type plate 92 (FIG. 5B) is secured, as by bolts 66 or the like, to the upper portion 86 of the thrust bearing 82 to retain such ball bearings 88 within the cavity 89.

The turntable drive means 93 (FIG. 5A) for continuously rotating the turntable 80 at a relatively slow speed, such as about 30 rpm, with respect to the first tower 28 has a turntable drive motor 54a (FIGS. 5A,10) mounted by means of brackets 94 (FIG. 5A) on the side of the tower frame 40 of the first tower 28 and has its drive shaft 96 (FIG. 5A) provided with a rotating pinion gear 98 (FIG. 5A) engageable with a girth gear 100 (FIGS. 5A,5B) on the periphery of the turntable 80.

The control means 70 has, as shown in FIG. 10, a line L5 disposed in parallel with the lines L3,L4 between the supply lines L1, L2 to energize the turntable rotating motor 54a upon closure of the normally open holding contact C3 of the relay 72 in the line L5.

Alternatively, it will be understood by those skilled in the art that a conventional indexing mechanism of the type shown in U.S. Pat. No. 2,569,852 issued to J. Greene on Oct. 2, 1951, (not shown) may be interposed between the pinion gear 98 (FIG. 5A) and the motor 54a (FIGS. 5A,10) on the drive shaft 96 for the purpose of intermittently indexing the turntable 80 a predetermined number of degrees, such as about 30°, for each short period of time, such as about 30 seconds.

The work platforms 84 (FIGS. 1,2,5B,6) are mounted on the turntable 80 and disposed thereon in quadrential spaced relation.

Work Platforms 84 (FIGS. 1, 2, 5B, 6)

Each work platform 84 (FIGS. 1,2,5B,6) is mounted on the turntable 80 as by welds 91 (FIG. 5B) or the like, is provided with a third refractory material aperture 38b (FIG. 2) and is movable on the turntable 80 from a vertical storage position (not shown in FIGS. 1 and 2) where each work platform 84 passes through the tower aperture 20 in the support member or collar 16, to a work position shown in FIGS. 1 and 2 where each work platform 84 extends beyond the turntable 80 to enable a workman (not shown) to stand on such work platform 84.

Each of the work platforms 84 has an inner portion 102 (FIGS. 1,2) extending from the turntable 80, which inner portion 102 telescopically surrounds an outer portion 104 (FIGS. 1,2) of the work platform 84 so that such outer platform 104 may be disposed a predetermined or desired distance D (FIG. 1) from the extremities of the inner portion 102 of the work platform 84. The work platform locking means utilized to lock the inner portion 102 to the outer portion 104 of the work platform 84 may suitably comprise a plurality of registering holes 106 (FIG. 1) in both the inner portions 102 and the outer portion 104 of such work platform 84. A locking means, such as a pin 108 (FIG. 1) may be inserted into such registering holes 106 in the inner portion 102 and in the outer portion 104 of the work platform 84.

It will be appreciated from a consideration of FIG. 1 that as the work platform approaches the upper portions of the refractory lining 11 in the furnace 10, the outer portion 104 of each work platform 84 is retracted inwardly from the original distance D to the smaller distance $D_1$ (FIG. 1) with respect to the inner portion 102 of the work platform 84.

A work platform operating means 110 (FIG. 1) is used to move each of the work platforms 84 from the above mentioned vertical storage position (not shown) on the turntable 84 to the work position shown in FIGS. 1,2.

Work Platform Operating Means 110 (FIG. 1)

This work platform operating means 110 (FIG. 1) may take the form of a hoist motor **54*b* depending from a beam 112 (FIG. 1) of the building in which the furnace 10 is housed. A plurality of four cables 60*a* (only one cable 60*a* being shown in FIG. 1) having hooks 114 are lowered so that each hook 114 engages the outer portion 104 of each work platform 84 and moves such work platforms 84 about the pivot 116 (FIGS. 1 and 2) when the hooks 114 and the cables 60*a* are elevated by the hoist 54*a* from the work position shown in FIG. 1 to a vertical storage position (not shown) where such work platforms 84 are substantially perpendicular to the turntable 80** (not shown).

Referring again to the control means 70 in FIG. 10, another parallel line L6 connects the hoist motor **54*b* for the hoist of the work platform operating means 110 through the normally open holding contact C4 of the relay 72 so that when such relay 72 is, of course, energized, the normally open holding contact C4 closes and the motor 54*b* for the hoist of the platform operating means 110** is energized.

A refractory material elevating means 118 (FIGS. 1, 10) is mounted on a platform head 117 (FIG. 1) the work platforms 84.

Refractory Material Elevating Means 118 (FIGS. 1, 10)

Figure 6:
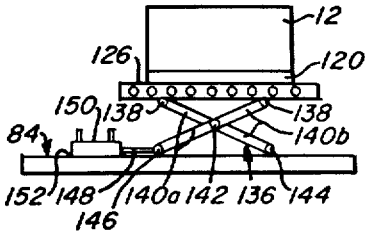
FIG. 6 is a fragmentary side elevational view taken along the line 6—6 of FIG. 2 in the direction of the arrows and showing an auxiliary elevating means on one of the work platforms for elevating the refractory material (carried by a pallet) and the conveying means on the work platform for supporting the pallet and for eliminating bending by a workman to pick up the refractory material.

Such refractory material elevating means 118 (FIGS. 1, 10) is engageable with the refractory material 12, suitably a pile of bricks **12*a* (FIGS. 1, 6) mounted on a pallet 120 (FIGS. 1, 6), which pallet 120 carries a conveyor roller section 122 (FIGS. 1, 2, 6). The refractory material elevating means 118 has a hoist motor 54*c* (FIGS. 1, 10) and utilizes a cable 60*c* (FIG. 1) extending from a drum 58*c* (FIG. 1) to a hook 114 (FIG. 1). The hook 114 is engageable with a plurality of cables 60*c* (FIG. 1) extending upwardly from the corners of the conveyor roller section 122 and gathered together to form a loop engageable with the hook 114 on the hoist cable 60*c***.

As shown in FIG. 10, the control means 70 has another parallel line L7 connecting the motor **54*c* for the hoist associated with the refractory material elevating means 118 to another normally open holding contact C5 of the relay 72 so that upon energization of the relay 72, the motor 54*c* for the refractory material elevating means 118** is energized.

Upon energization of the motor **54*c* for the hoist associated with the refractory material elevating means 118, the refractory material 12 on the pallet 120 and the conveyor roller section 122 are raised through the refractory material aperture 38 in the first tower 28, the second refractory material aperture 38*a* in the turntable 80 and the third refractory material aperture 38*b*** in the work platforms 84 so that the refractory material 12 can be transferred to an individual work platform 84 on a conveyor means 124 (FIGS. 1, 2).

Conveyor Means 124 (FIGS. 1, 2)

As shown in FIGS. 1 and 2, each work platform 84, when in the extended work position shown in FIGS. 1 and 2, is provided with a conveyor means 124, such as a conveyor section 126, which conveyor section 126 (FIGS. 1, 2) is registerable with the conveyor roller section 122 on the pallet 120 when the refractory material elevating means 118 raises such refractory material 12, pallet 120 and conveyor roller section 122 to the transfer position shown in FIG. 1. The conveyor locking means utilized to lock the conveyor section 126 on the work platform 84 to the conveyor roller section 122 is a door-type slide lock 128 (FIG. 2) having a slide 130 (FIG. 2) retained in a slide holder 132 (FIG. 2) on the conveyor section 126 and movable into engagement with a slide holder 133 (FIG. 2) mounted on the end portions of the conveyor roller section 122 on the pallet 120. This locked position for transferring the pallet 120 and the refractory material 12 to a conveyor section 126 on a work platform 84 is shown in FIG. 2. In such locked position shown in FIG. 2, the pallet 120 and the refractory material 12 are rolled off the conveyor roller section 122 onto the conveyor section 126 on the individual work platform 84 to a work position on such work platform 84 thereby completing the delivery of the refractory material 12 on the pallet 120 from adjacent the third refractory material aperture **38*b* in the work platform 84 to the work position shown in FIG. 1**.

SUMMARY OF THE PREFERRED EMBODIMENT OF THE APPARATUS 14 (FIGS. 1–6, 10)

From the above description of the apparatus 14 (FIGS. 1–6, 10) it will be apparent the present invention contemplates the provision of guide means such as the tower guides 42 (FIGS. 1, 2) within the first tower 28 to guide the refractory material 12 through the refractory material aperture 38 in the first tower 28 (FIG. 2). The tower elevating means 34 is either mounted on the support member or collar 16 as shown in FIGS. 1 and 2 or is mounted on the first tower 28 (not shown). As shown in FIG. 2, the conveyor locking means, such as the door type slide lock 128 shown in FIG. 2 may be disposed on one member of the conveyor roller section 122 for carrying the pallet 120 and the conveyor section 126 to lock the other member of the conveyor roller section 122 and the conveyor section 126 to the one member. Connecting means, such as the cable 60, clevis 62 and the lug 64 on the frame 40 of the first tower connects the tower elevating means 34 to the first tower 28 (FIGS. 4A, 4B).

Auxiliary Elevating Means 136 (FIG. 6)

Referring now to FIG. 6, it will be understood that auxiliary elevating means 136 may be disposed on each of the work platforms 84 for elevating the pallet 120 and the refractory material 12 carried thereby above the work platform 84 to eliminate bending of a workman (not shown) to pick up the refractory material 12. In this embodiment, the conveyor section 126 is pivotally mounted at 138 (FIG. 6) on scissored levers **140*a* and 140*b* (pivoted on each other at 142). As shown in FIG. 6, the lower portion of the lever 140*a* is pivoted on the work platform 84 at 144 while the lower end of the other scissored lever 140*b* has its lower end portion pivotably connected at 146 to a piston 148 of a hydraulic fluid cylinder 150 secured to the work platform 84 as by welds 152**.

In addition, it will be understood that form means, such as the form ring 32 or the like (FIG. 1), are provided on the support member or collar 16 and extend into the bottom aperture 18 of the furnace 10 for defining the end of the refractory lining 11 adjacent the bottom of the furnace 10.

As shown in FIG. 1, tower locking means (such as the registerable locking apertures 36 in the support member or collar 16 and in the first tower 28 and the pin 54 extending through such registerable holes 36) is disposed between the support member 16 and the first tower 28 to lock the first tower 28 to the support member 16, thereby permitting removal of the connecting means, i.e., the cable 60, clevis 62, etc. (FIGS. 4A, 4B) between the tower elevating means 34 and the first tower 28 at 52, so that such connecting means may later be reconnected to the second tower **28*a* at 52*a* (FIG. 1**).

Second Tower **28*a* (FIG. 1**)

This second tower **28*a* (FIG. 1) is similar in construction to the first tower 28 and is provided with another refractory material aperture 38*c* (FIG. 1). Such second tower 28*a* is connected to the bottom of the first tower 28 by tower connecting means, such as bolts 66 (extending through holes 37 (FIG. 1) in the two towers 28, 28*a*) and nuts 68 (FIG. 1) so that the refractory material aperture 38 in the first tower 28 registers with the other refractory material aperture 38*c* in the second tower 28*a***.

Thereafter, the connecting means shown in FIGS. 4A, 4B are connected to the second tower **28*a* at 52*a* (FIG. 1**).

Again as shown in FIG. 2, the space between adjacent work platforms 84 (FIG. 2) is covered or filled by a platform section 156 (FIG. 2) thereby providing a continuous peripheral work space about the turntable 80.

It will also be understood that the work platform operating means 110 (FIG. 1) is connectable to each of the four work platforms 84 for moving each of the work platforms 84 between the storage position (not shown) and the work position shown in FIGS. 1, 2.

Further, the turntable 80 (FIGS. 1, 2, 5A, 5B) has a unique thrust bearing 82 (FIGS. 5A, 5B) which takes the thrust of the apparatus 14 both in a vertical and a horizontal direction as shown in FIGS. 5A and 5B.

ALTERNATIVE EMBODIMENTS

Figure 7:
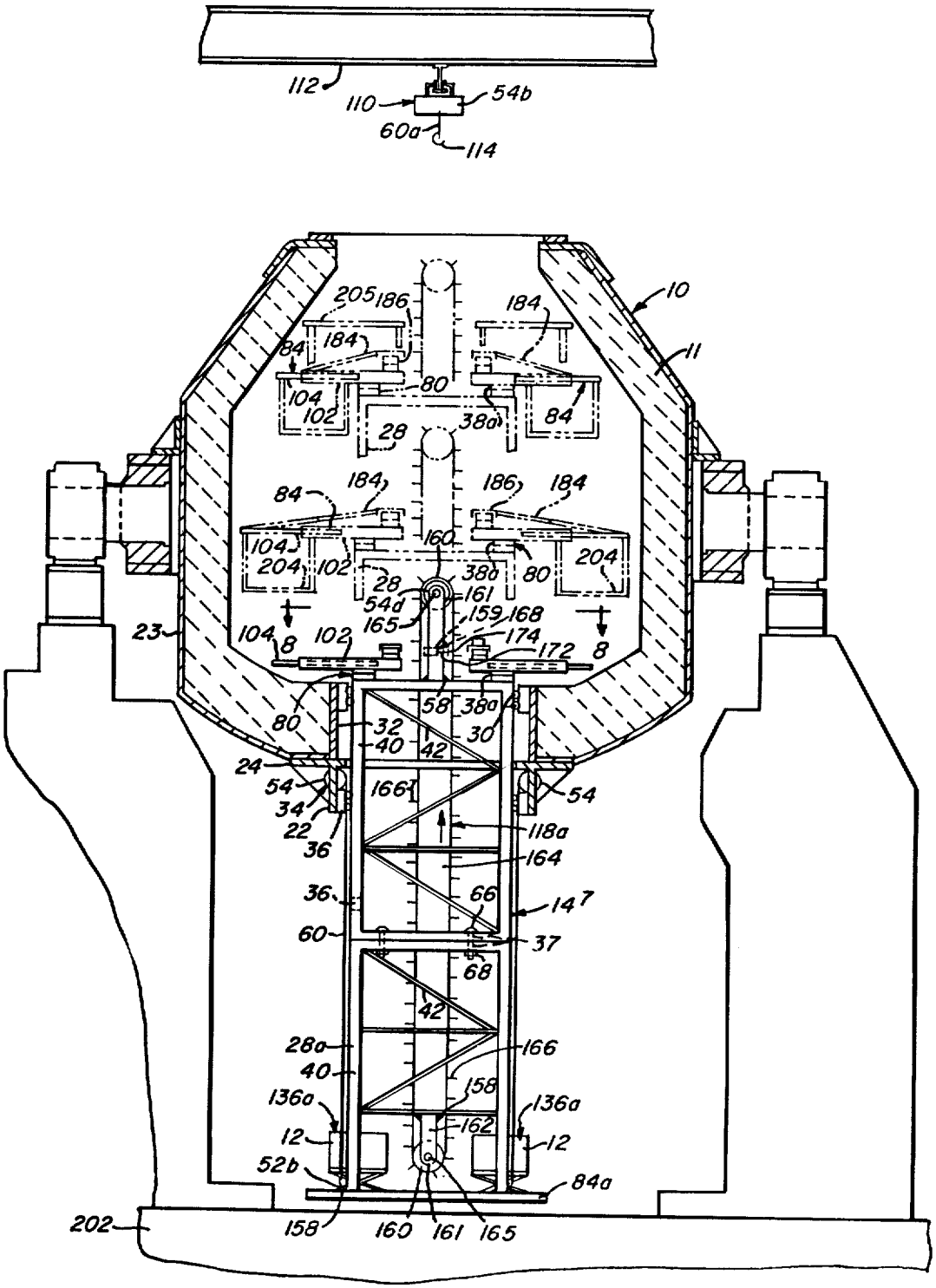
FIG. 7 is a view similar to FIG. 1 of an alternative embodiment of the apparatus showing a second tower secured to the bottom of the first tower; the tower elevating means connected to the second tower, second work platforms secured to the bottom of the second tower; an alternative embodiment of the refractory material elevating means which is operable to convey a single predetermined amount of the refractory material (such as a single brick) from the second work platforms into alignment with the first work platforms; kick off means mounted on the work platforms for removing the refractory material or single brick from the refractory material elevating means onto the work platforms; material feeding means on the work platforms movable with respect to such work platforms and for feeding the single brick, when such single brick is adjacent the work platforms to a predetermined position on one of the work platforms; wiping means on the work platforms extending into the rotary path of movement of the single brick on the material feeding means to engage and cause the single brick to transfer from the material feeding means to one of the work platforms; brick mason stands depending from the work platforms to eliminate bending of the workman to pick up the refractory material or single brick; and other auxiliary elevating means on the second work platforms for elevating the refractory material or bricks above the second work platforms to eliminate bending of the workman to pick up the refractory material.
Figure 8:
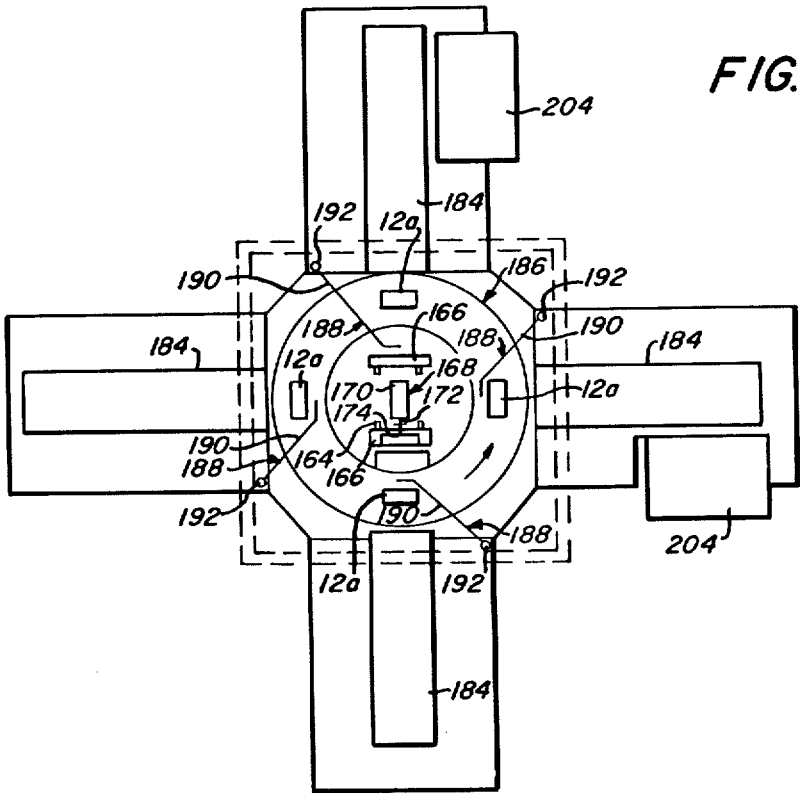
FIG. 8 is a horizontal sectional view taken along the line 8—8 of FIG. 7 in the direction of the arrows and showing the work platforms; the brick mason stands depending from the work platforms, the refractory material elevating means operable to elevate a single brick from the lower or second work platforms; the kick off device; the rotatable material feeding means on the turntable; the wiper means mounted on the upper work platforms and material chutes for guiding the single brick from the wiping means onto work platforms and breaking off the material chutes adjacent the inner ends of the work platforms for clarity.
Figure 9:
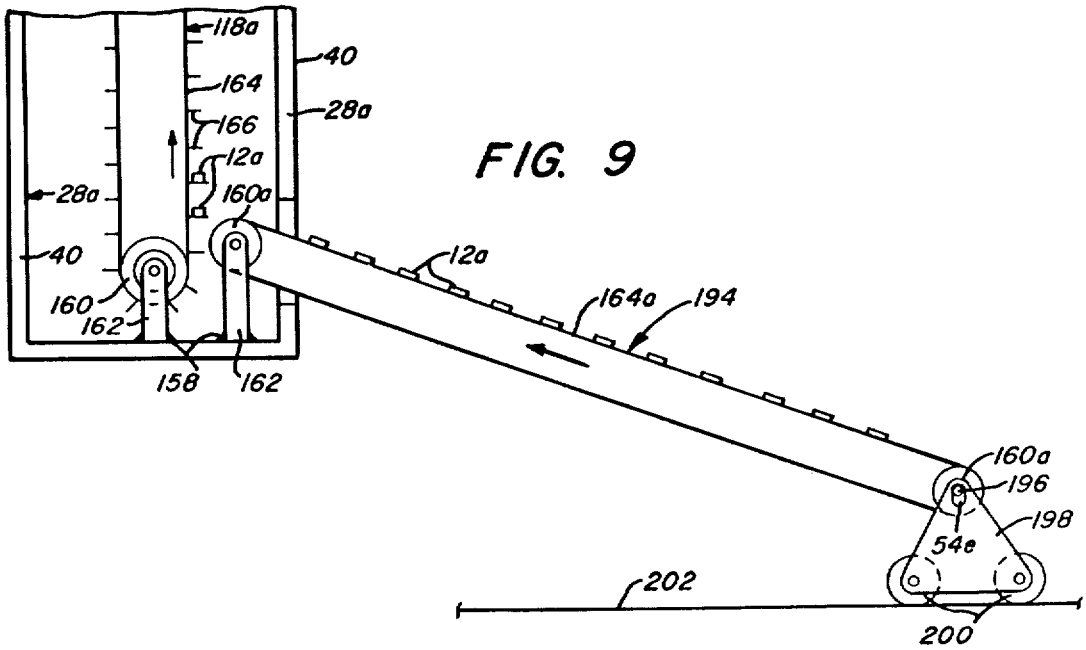
FIG. 9 is a fragmentary side elevational view partially in section of the lower portions of the second tower, and the refractory material elevating means for conveying a single brick from the second or lower work platforms into alignment with the upper work platforms and showing a second material feeding means connected at one end to the bottom of the refractory material elevating means and adapted to feed the single bricks to the bottom of the refractory material elevating means as the first tower and the second tower are raised by the tower elevating means.

It will be understood by those skilled in the art that alternatively as shown in FIGS. 7–9, the preferred embodiment 14 (FIGS. 1–6) may be modified to form the alternative embodiment of the apparatus 14'.

Second Work Platforms **84*a* (FIG. 7**)

A series of second work platforms **84*a* (FIG. 7) are secured as by welds 158 (FIG. 7) or the like to the bottom of the second tower 28*a* for receiving the pallet 120*s* carrying the refractory material 12. The refractory material elevating means 118*a* shown in FIG. 7 is operable to convey a single predetermined amount of the refractory material 12, such as one brick 12*a* (FIGS. 8, 9) from these second work platforms 84*a* into alignment with the first work platforms 84 on the top of the first tower 28**.

Refractory Material Elevating Means 118*a* (FIGS. 7–9)

As shown in FIG. 7, the refractory material elevating means 118*a* has a pair of sprockets 160 (FIG. 7) mounted on bearings 161 (FIG. 7) in brackets 162 (FIGS. 7, 9) extending from the frame portions 40 of the first tower 28 and the second tower 28*a*. An endless belt or chain 164 (FIGS. 7, 8, 9) provided with spaced carriers 166 (FIGS. 7, 8, 9) for elevating the single bricks 12*a* from a receiving position adjacent the lower portions of the refractory material elevating means 118*a* upwardly into alignment with one of the work platforms 84 on the top of the first tower 28 in the direction of the arrow shown in FIG. 7.

As shown in FIG. 7, the upper sprocket 160 of the refractory material elevating means 118*a* (FIG. 7) is driven by a shaft 165 (FIG. 7) extending from a motor 54*d* (FIGS. 7 and 10). The control means 70 (FIG. 10) utilizes another parallel line L8 to connect the motor 54*d* for the refractory material elevating means 118*a* through a normally open holding contact C7 of the relay 72 between the voltage supply lines L1 and L2.

Kick Off Means 168 (FIGS. 7, 8, 10)

Kick off means 168 (FIGS. 7, 8, 10), such as a fluid cylinder 170 (FIGS. 7 and 8) mounted as by welds 158 (FIG. 7) to the bracket 162 has its piston 172 (FIGS. 1, 8, 10) provided with a pusher 174 (FIGS. 7, 8, 10) for removing a single refractory brick 12*a* from a spaced carrier 166 on the refractory material elevating means 118*a* when such single brick 12*a* comes into alignment with the kick off means 168.

The control means 70 for the kick off means 168 (shown in FIG. 10) has another parallel line L8*a* connecting a timer 176 (FIG. 10) through a solenoid 178 (FIG. 10) and a normally open holding contact C6 of the relay 72 and another manually operated normally closed stop switch 76[11] (FIG. 10). At the appropriate timed interval, the timer 170 energizes the solenoid 178 to operate a valve 180 (FIG. 10) to cause the fluid pressure in a supply line 182 (extending from a fluid source indicated by the legend "From Fluid Supply") to the left hand end (as viewed in FIG. 10 of the fluid cylinder 170) to advance the piston 172 and the pusher 174 thereby causing the removal of a single brick 12*a* from an adjacent carrier 166 of the refractory material elevating means 118*a* (FIG. 7). Thereafter, after the removal of the single brick 12*a* by the kick off means 168, the timer 176 causes retraction of the solenoid 178 thereby reversing the flow of fluid to the right hand end of the fluid cylinder 170 and causing retraction of the piston 172 and the pusher 174 carried thereby (FIG. 10).

Material Guide Means 184 (FIGS. 7, 8)

As shown particularly in FIGS. 7 and 8, each of the work platforms 84 is provided with a material guide means, such as a telescoping or extendable chute 184 or the like for receiving the single brick 12*a* which has been fed by the kick-off means 168 onto a frusto conical rotatable material feeding means or table 186 (FIGS. 7 and 8).

Material Feeding Means 186 (FIGS. 7, 8)

This rotatable frusto conical inclined material feeding table 186 receives the single brick 12*a* from the carrier 166 of the refractory material elevating means 118*a* (FIG. 7) due to the timed operation of the kick-off means 168 and delivers such single brick 12*a* down its inclined surface until the brick is transported contiguous to a wiper means 188 (FIG. 8). The material feeding table 186 is mounted on the rotatable work platforms 84 on the rotatable turntable 80 and rotates or indexes, as desired, with such turntable 80.

Wiper Means 188 (FIGS. 7, 8)

Each of the wiper means 188 (FIG. 8) comprises a resilient arm 190 (FIG. 8) mounted on an inside corner of each work platform 84 at 192. Each such wiper arm 190 extends into the rotary path of movement of the single refractory brick 12*a* on the rotatable material feeding table 186, engages the brick 12*a* and causes such brick 12*a* to transfer from the inclined surface of the material feeding table 186 onto the material chute 184 on the adjacent work platform 84 (FIG. 8).

Auxiliary Elevating Means 136*a* (FIG. 7)

Also as shown in FIG. 7, auxiliary elevating means 136*a* of the type shown in FIG. 6 may be mounted on the second work platforms 84*a* secured to the bottom of the second tower 28*a* to elevate the refractory material 12 above the second work platforms 84*a* thereby eliminating bending of a workman (not shown) to pick up such refractory material 12.

Second Material Feeding Means 194 (FIG. 9)

Referring now to FIG. 9, a second material feeding means or conveyor 194 is shown for feeding the refractory material 12 or single bricks 12*a* to the bottom of the refractory material elevating means 118*a* (FIGS. 7 and 9). The left hand sprocket 160*a* (FIG. 9) of the conveyor 194 is pivotably mounted on a bracket 162 (FIG. 9) upstanding from the frame 40 of the second tower 28*a*.

The right hand sprocket 160*a* (FIG. 9) of the conveyor 194 is pivotably mounted at 196 on a carriage 198 (FIG. 9), which carriage 198 rides by means of wheels 200 (FIG. 9) on the floor 202 of the building which houses the furnace 10. As shown in FIGS. 9 and 10, a motor 54*e* drives the right hand sprocket 160*a* and hence the conveyor belt or chain 164*a* in the direction of the arrow shown in FIG. 9. As the bricks 12*a* fall off the end of the left hand sprocket 160*a* of the conveyor 194, the bricks 12*a* are deposited on a carrier 166 of the refractory material elevating means 118*a* and transmitted upwardly in the direction of the arrow (FIG. 9) as hereinbefore explained.

The control means 70 (FIG. 10) has a line L9 connecting the motor 54*e* through contact C8 to switch 76*e*.

Brick Mason Stand 204 (FIGS. 7, 8)

Referring again to FIGS. 7, 8, each of the work platforms 84 mounted on the turntable 80 may be provided with a removable fold-up type brick mason stand 204 which depends below each of the work platforms 84 thereby enabling a workman (not shown) to stand on such brick mason stand 204 to eliminate bending of the workman (not shown) to pick up the refractory bricks 12*a* (FIGS. 7 and 8).

As shown in FIG. 7, a wood scaffold 205 may be mounted on the work platforms 84 for work on the top of the furnace 10.

The hoist 54*a* (FIG. 7) can be used to move work platforms 84 between the work position (FIG. 7) and the storage position (not shown).

Figure 11:
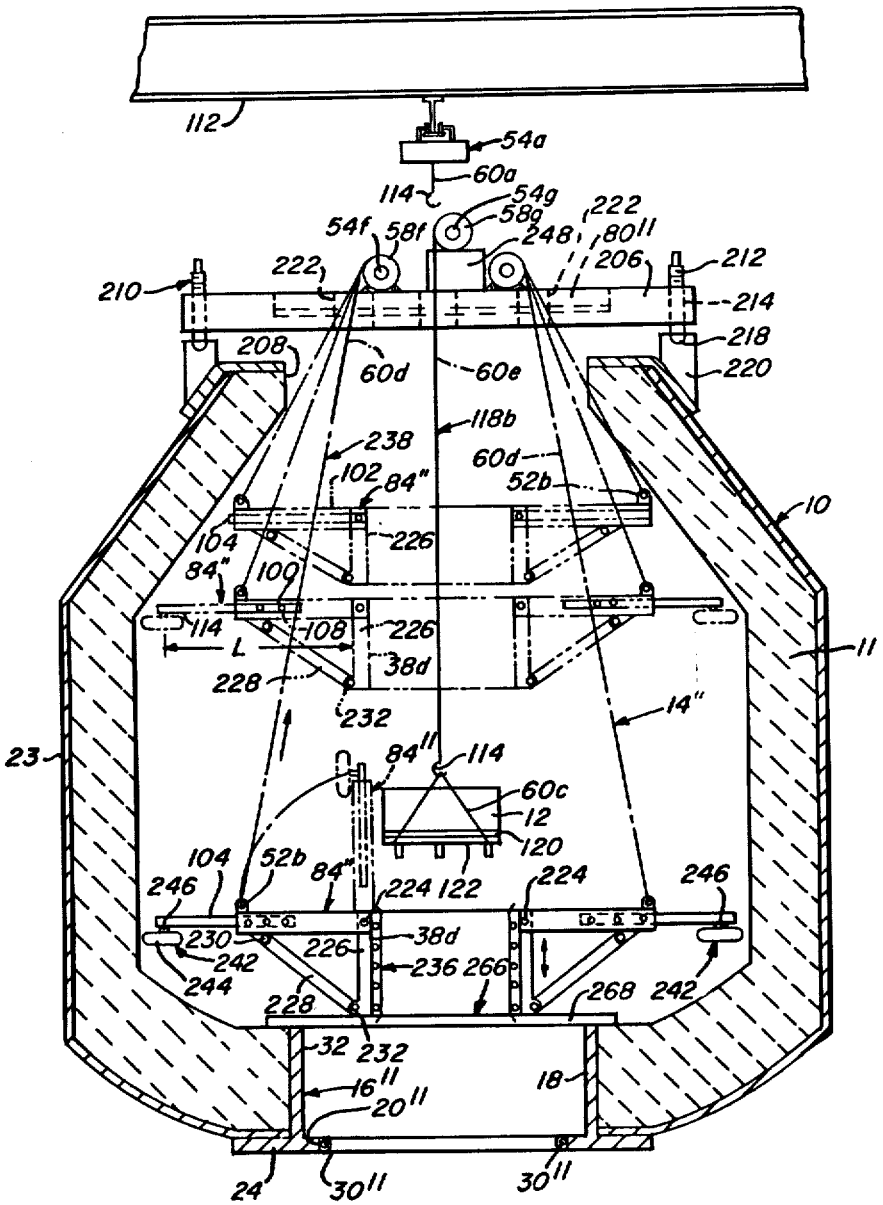
FIG. 11 is a view similar to FIG. 1 of another alternative embodiment of the apparatus and showing a table support member secured to the furnace adjacent the top aperture of the furnace; a turntable rotatable on the table support member and provided with work platform elevating means clearance holes or apertures; the work platforms movable through the bottom aperture in the furnace to a desired work position within the furnace; refractory material elevating means on the turntable, extending through the table support member, and connectable to the refractory material (mounted on a pallet) for moving the refractory material through the refractory material aperture in the work platform so that the refractory material can be transferred from the refractory material elevating means to the work platform.

Alternative Apparatus $14^{11}$ (FIG. 11)

The apparatus $14^{11}$ shown in FIG. 11 for lining a furnace 10 with the innerlining 11 of the refractory material 12 has a table support member 206 (FIG. 11) secured to the furnace 10 adjacent a top aperture 208 (FIG. 11) in the furnace 10. For the purpose of levelling the table support member 206, the apparatus $14^{11}$ is provided with levelling means 210 (FIG. 11).

Levelling Means 210 (FIG. 11)

As shown in FIG. 11, a plurality of levelling screws 212 are threadable into suitable threaded holes 214 in the table support member 206 and have their projecting ends 216 engageable in sockets 218 provided in brackets 220 (FIG. 11) upstanding from the outer shell 23 of the furnace 10.

In the embodiment of FIG. 11, the turntable $80^{11}$ is rotatable on the table support member 206 in the manner described with respect to the apparatus 14 shown in FIGS. 1–6, 10 and $14^7$ (FIGS. 7–9, 10) and such turntable $80^{11}$ is provided with work platform elevating means clearance apertures 222 (FIG. 11).

The work platforms $84^{11}$ (FIG. 11) are again movable through the bottom aperture 18 in the furnace 10 while they are in the vertical storage position (shown in dotted lines in FIG. 11) and are then further movable as hereinbefore described with respect to the apparatus 14 shown in FIGS. 1–6, 10 and $14^7$ (FIGS. 7–10) to the work position shown in solid lines in FIG. 11 to enable a workman (not shown) to stand on the work platforms $84^{11}$. Each of the work platforms $84^{11}$ are pivotably mounted at 224 (FIG. 11) on a frame 226 (FIG. 11) of such work platform $84^{11}$. Supporting rods 228 (FIG. 11) are fixedly and pivotably connected at 230 (FIG. 11) to the outer end of the outer section 104 of each work platform $84^{11}$ and have their lower portion pivotably and removably secured by means of a removable pin 232 to the lower portion of the frame 226 of each work platform $82^{11}$.

In addition, each work platform $84^{11}$ is provided with a refractory material aperture 38*d*, which aperture 38*d* (FIG. 11) has mounted on the walls thereof pallet guide means suitably a plurality of rollers $30^{11}$ similar to the tower guide rollers 30 shown in FIGS. 1 and 2.

Work Platform Elevating Means 238 (FIG. 11)

A work platform elevating means 238 (FIG. 11) comprises a plurality of hoists driven by motors 54*f* (FIGS. 10 and 11). Each hoist has its cable 60*d* (FIG. 11) extending through the clearance holes 222 in the table support member 206 (FIG. 11) to a connecting means 52*b* (FIG. 11) of the type shown in FIGS. 4A and 4B and indicated diagrammatically in FIG. 11 at 52*b*.

After removal of the pin 232 (FIG. 11) and energization of the relay 72, closure of its normally open holding contact C9 (FIG. 10) energizes the motor 54*f* for the hoist of the work platform elevating means 238. This motor 54*f* (FIGS. 10, 11) is mounted on the turntable $80^{11}$ to cause the hoists (and the drums 58*f*, FIG. 11, driven by the hoist motors 54*f*) to move each of the work platforms $84^{11}$ from the solid line working position shown in FIG. 11 to the dotted line position or vertical position shown in FIG. 11.

It will be understood that the work platform elevating means 238 may be mounted on either the turntable $80^{11}$ or the work platforms $84^{11}$, will extend through the clearance holes 222 in the table support member 206 and may be connected to the other member of the turntable $80^{11}$ and the work platforms $84^{11}$ for moving the work platforms $84^{11}$ (while in the storage position shown in the vertical dotted line position of FIG. 11) through the bottom aperture 18 in the furnace 10 to a desired work position within the furnace shown in the various solid line positions of FIG. 11. It will also be appreciated from a consideration of FIG. 11 that each work platform $84^{11}$ is provided with an inner portion 102 telescopically surrounding an outer portion 104, the outer portion 104 being extendable with respect to the inner portion 102.

Platform Guide Means 242 (FIG. 11)

A platform guide means 242 (FIG. 11) is suitably a plurality of rubber guide wheels 244 mounted by means of a shaft 246 on the end of outer portion 104 of each work platform $84^{11}$. Each wheel 244 is engageable in the embodiment shown in FIG. 11 with the refractory lining 11 of the furnace 10 to stabilize and center the work platforms 84 within such furnace 10 (FIG. 11). It will be understood that the platform guide means 242 can be carried by the innerlining 11 of the furnace 10, and be engageable with the outer extremmities of the outer portion 104 of each of the work platforms $84^{11}$.

Refractory Material Elevating Means 118*b* (FIG. 11)

This refractory material elevating means 118*b* (FIG. 11) is mounted on a bracket 248 (FIG. 11) upstanding from the turntable $80^{11}$, has its cable 60*e* extending through a clearance hole 222 in the table support member 208 and has its hook 114 on the end of the cable 60*e* connected to the cables 60*c* extending from the conveyor roller section 122, which section 122 supports the pallet 120 carrying the refractory material 12. Such refractory material elevating means 118*b* has a drum 58*g* (FIG. 11) driven by a hoist having a motor 54*g* (FIG. 11). The control means 70 shown in FIG. 10 utilizes a parallel line L10 for connecting the motor 54*g* of the refractory material elevating means 118*b* (FIG. 11) to a normally open holding contact $C_{10}$ of the relay 72.

It will be noted that the lower portions of the support member $16^{11}$ has guide rollers $30^{11}$ disposed adjacent a work platform aperture $20^{11}$ for guiding the movement of the work platforms $84^{11}$ through the bottom aperture 18 in the furnace 10.

Work Platform Support Means (FIG. 11)

Figure 13:
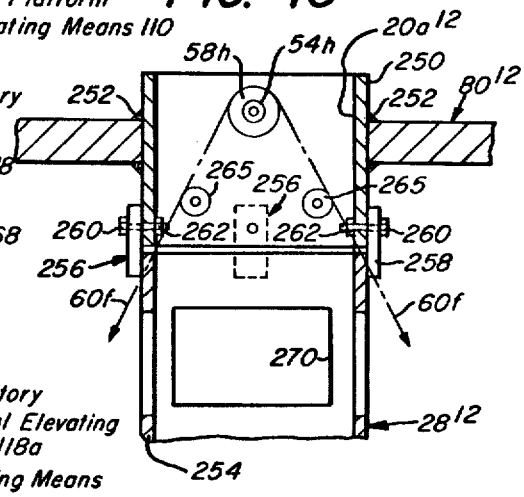
FIG. 13 is a fragmentary enlarged vertical sectional view showing the means of securing the tower head to the turntable, as by welding or the like, and the means for connecting the first tower to the tower head.
Figure 12:
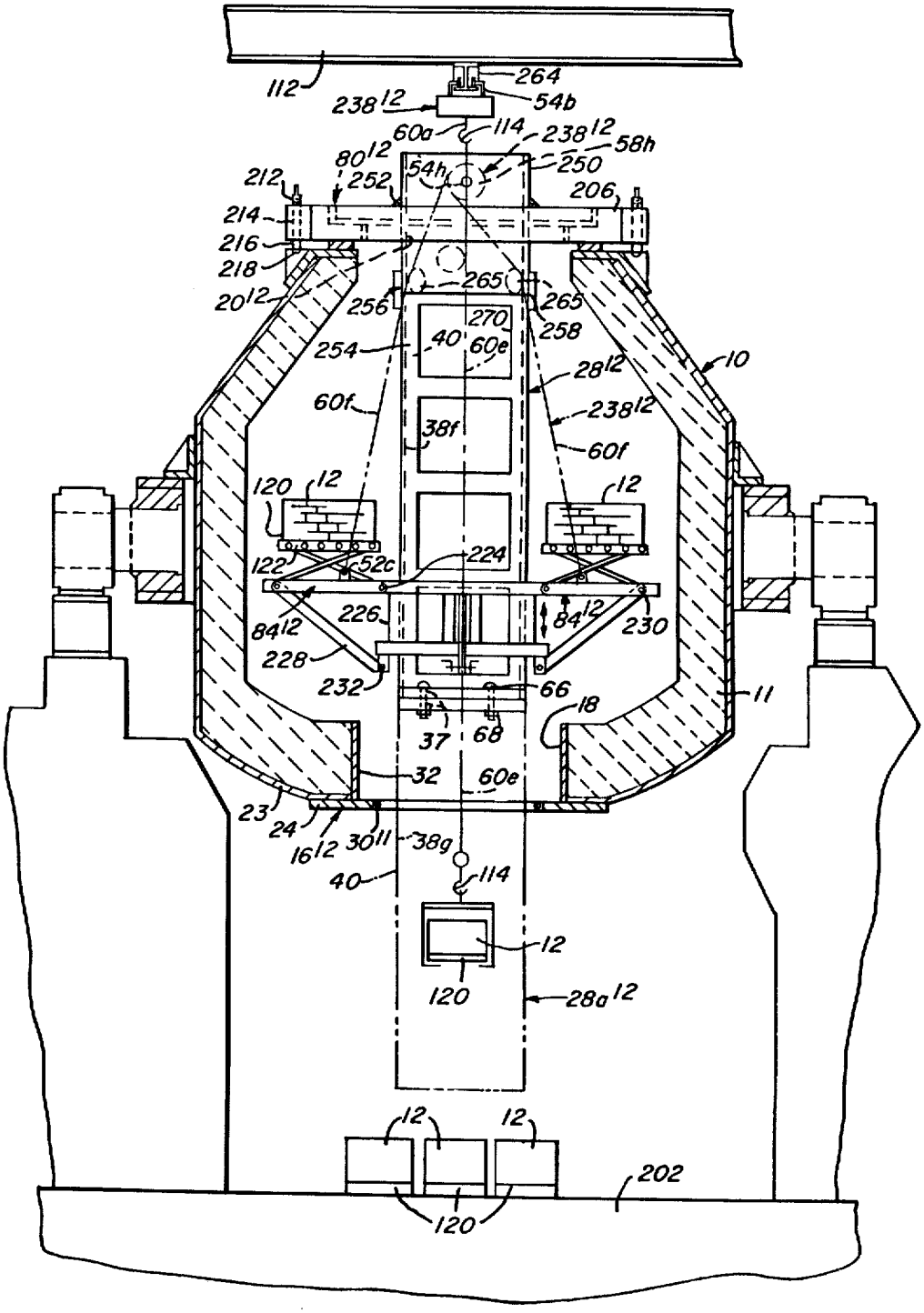
FIG. 12 is a view similar to FIG. 11 of another alternative embodiment of the apparatus and showing a tower head secured to the turntable (rotatable on the table support member); a first tower secured to the tower head; a second tower conneced to the lower portions of the first tower; and the work platforms vertically reciprocable on both the first tower and the second tower.

It will be appreciated from a consideration of FIG. 11 that a work platform support means 266 (FIG. 11) may be utilized in the apparatus $14^{11}$ shown in FIG. 11 and the apparatus $14^{12}$ shown in FIGS. 12 and 13. This work platform support means 266 (FIG. 11) bridges the bottom aperture 18 in the furnace 10 and supports the work platforms $84^{11}$ (FIG. 11) or $84^{12}$ (FIG. 12) during movement of the work platforms $84^{11}$ and $84^{12}$ between the storage positions shown in the dotted vertical position of FIG. 11 and the work position shown in solid lines in FIGS. 11 and 12.

This work platform support means 266 has one or more removable plates or rods 268 which are disposable beneath the work platforms $84^{11}$ or $84^{12}$ (as shown in FIG. 11) and engage the bottom portions of such work platforms $84^{11}$ and $84^{12}$.

SUMMARY OF ALTERNATIVE EMBODIMENTS OF FIGS. 7 AND 11

It will be understood as shown in FIG. 1 that the work platform locking means for the apparatus 14[11] (FIG. 11) for connecting the outer portion 104 to the inner portion 102 of each work platform 84[11] may comprise the registering holes 106 in such sections 102, 104 and the removable pins 108. Such work platform locking means secures the outer portion 104 and the inner portion 102 of each work platform 84[11] together in a desired predetermined length such as L or $L_1$ (FIG. 11).

It will be understood from a consideration of FIG. 11 that the work platform elevating means 238 may be either mounted on the table support member 206 or on the work platforms 84[11].

In addition, it will also be understood that the apparatus 14[11] may include the following features described with respect to the apparatus 14 shown in FIGS. 1–6, 10 and 14[7] (FIGS. 7–10):

a. the conveyor means 124, i.e., the conveyor sections 106 (FIGS. 1, 2) on the work platforms 84[11] extending from the refractory material aperture 38*d* in each work platform 84[11] to the work position (FIG. 11) on each work platform 84[11] for delivering the refractory material 12 from such refractory material aperture 38*d* (FIG. 11) in the work platform 84[11] to the work position on the work platform 84[11] (FIG. 11);

b. the refractory material 12 may be carried by a pallet 120 (FIG. 11) which pallet 120 in turn is supported by a conveyor section 122, the conveyor section 122 being alignable with the conveyor means 124 to permit the transfer of the pallet 120 and the refractory material 12 from the conveyor section 122 to the conveyor means 124 on the work platforms 84[11] as shown in FIGS. 1, 2;

c. a refractory material elevating means 118*a* (FIG. 7) may be employed to convey a single brick 12*a* of the refractory material 12 into alignment with the work platform 84[11] (FIG. 11);

d. the kick-off means 168 (FIGS. 7 and 8) may be mounted on the work platforms 84[11] (FIG. 11) for removing the refractory brick 12*a* from the refractory material elevating means 118*a* (FIG. 7) onto the work platform 84[11] (FIG. 11);

e. the material guide chute 184 (FIGS. 7 and 8) can be utilized on the work platforms 84[11] (FIG. 11) for guiding the refractory brick 12*a* from the rotatable material feeding means 186 (FIGS. 7 and 8) when the refractory brick 12*a* is adjacent the work platform 84[11] (FIG. 11);

f. form means, such as the form ring 32 shown in FIG. 1, may be disposed adjacent the bottom aperture 18 of the furnace 10 for defining the end of the refractory material 11 in the bottom of the furnace 10 (FIG. 11);

g. the plurality of spaced work platforms 84[11] (FIG. 11) may be connected by platform sections 156 (FIG. 2) to bridge the space between the adjacent work platforms 84[11] (FIG. 11);

h. the second material feeding means or conveyor 194 (FIG. 9) may be connected at one end to the bottom of the refractory material elevating means 118*a* (FIG. 9) and adapted to feed the refractory brick 12*a* to the bottom of such refractory material elevating means 118*a* (FIG. 9) as the work platforms 84[11] (FIG. 11) are raised by the work platform elevating means 238 (FIG. 11);

i. brick mason stands 204 shown in FIGS. 7 and 8 may depend from the work platforms 84[11] (FIG. 11) to eliminate bending of a workman (not shown) to pick up the refractory material or brick 12*a;* j. the turntable 80[11] (FIG. 11) may be a thrust bearing 82 of the type shown in FIGS. 5A, 5B and takes the thrust of the apparatus 14[11] (FIG. 11) in both the vertical and horizontal directions;

k. the wiping means 188 shown in FIGS. 7, 8 may be mounted on the work platforms 84[11] to extend into the rotary path of movement of the refractory brick 12*a* on the material feeding means or table 186 (FIGS. 7, 8) to engage and cause the refractory brick 12*a* to transfer from the material feeding table 186 to chutes 184 on the adjacent work platform 84[11] (FIG. 11).

The hoist 54*a* (FIG. 11) may be used to move the work platforms 84[11] between the solid line work position and the dotted line storage position.

Apparatus 14[12] (FIGS. 12, 13)

The apparatus 14[12] (FIGS. 12, 13) has the table support member 206 provided with a tower aperture 20[12] and the turntable 80[12] is provided with a second tower aperture 20*a*[12]. A tower 28[12] (FIGS. 12, 13) is adapted to pass through the tower aperture 20[12] in the table support member 206 and the second tower aperture 20*a*[12] in the turntable 80[12].The tower 28[12] is provided with a refractory material aperture 38*f* and is secured to the turntable 80[12], as shown in FIG. 13 as by welds 252 or the like.

As shown in FIG. 12, the work platforms 84[12] are provided with a tower aperture 20*b*[12] and are reciprocable on the outside of the tower 28[12]. The tower 28[12] has a tower head 250 (FIGS. 12, 13) which head 250 has its projecting upper portion secured, as by welds 252, to the turntable 80[12] and its lower depending portions secured by means of tower locking means 256 (FIGS. 12, 13). This tower locking means 256 consists of a locking ring 258 (FIGS. 12, 13) projecting from the upper portion 254 of the tower 28[12] and secured to the lower portion of the tower head 250 by bolts 260 and nuts 262 (FIG. 13).

In this embodiment, the work platform elevating means 238[12] (FIG. 12) can be mounted on either a tower elevating mounting means, such as a bracket 264 (FIG. 12), depending from the beam 212 of the building in which the furnace 10 is housed or on the tower head 250 as shown in FIG. 12. The work platform elevating means 238[12] is then connected to the other member of the tower elevating mounting bracket 264 or to the tower 28[12] to elevate the work platforms 84[12] to a predetermined position within the furnace 10 with respect to the turntable 80[12].

The work platform elevating means 238[12] may utilize a hoist motor 54*h* (FIGS. 10, 12) for a drum 58*h* (FIG. 12), cables 60*f* passing around guide sheaves 265 on the tower head 250, hooks 114 and the connections 52*c* between the cables 60*f* and the work platforms 84[12] of the type shown in FIGS. 4A and 4B. The hoist motor 54*h* is mounted on the tower head 250 as shown in FIGS. 12, 13. Alternatively, the work platform elevating means 238[12] may have hoist motor 54*b* (FIG. 12), may be similarly connected, as above described, to accomplish the elevating of the work platforms 84[12] on the tower 28[12] or to raise the work platforms 84[12] from the working position shown in FIG. 12 to the storage position not shown in FIG. 12.

SUMMARY OF ALTERNATIVE EMBODIMENT OF FIGS. 12, 13

The tower $28^{12}$ is provided with guide means, such as the guides 44 shown in FIGS. 1 and 3 to guide the refractory material 12, the pallet 120 and if necessary, the roller section 122 beneath the pallet 120 through the refractory material apertures 38*f* (FIG. 12) in the tower $28^{12}$ (FIG. 12) defined by the guides 44 of FIGS. 1, 3.

The work platform elevating means $238^{12}$ (as shown in FIG. 12) is mounted on the tower $28^{12}$. Alternatively, the work platform elevating means $238^{12}$ may be mounted on the work platforms $84^{12}$. The connecting means 52*c* (FIG. 12) of the type shown in FIGS. 4A and 4B include the cables 60*f*, the clevis 62 and the lugs 64 (FIGS. 4A, 4B) to connect the platform elevating means $238^{12}$ to the tower $28^{12}$ (FIGS. 4A, 4B). Further, as shown in FIG. 7, a second work platform (not shown in FIG. 12, but similar to the work platforms 84*a*, FIG. 7) may be mounted on either the bottom of the tower $28^{12}$ or a second tower $28a^{12}$. This second tower $28a^{12}$ (FIG. 1) is provided with another refractory material aperture 38*g* and such second tower $28a^{12}$ is connected to the bottom of the tower $28^{12}$ so that the refractory material aperture 38*f* in the tower $28^{12}$ registers with the other refractory material aperture 38 *g* in the second tower $28a^{12}$.

It will be further understood that the tower $28^{12}$ and the second tower $28a^{12}$ may be telescopic with respect to each other.

Referring again to FIGS. 12, 13, it will be noted that each of the towers $28^{12}$ and $28a^{12}$ are provided on their side faces with openings 270 through which the refractory material 12 and the pallet 120 can be passed for transfer to a selected work platform $84^{12}$.

METHOD

It will be understood by one skilled in the art from the above description of the apparatus 14 (FIGS. 1–6, 10) the apparatus $14^{7}$ (FIGS. 7–9, 10), the apparatus $14^{11}$ (FIG. 11) and the apparatus $14^{12}$ (FIGS. 12 and 13) that improved methods of lining a furnace are part of the present invention. The preferred method includes the steps of:

a. securing at 26 a support member or collar 16 (FIG. 1) to the bottom of the furnace 10 in registry with a bottom aperture 18 of such furnace 10;

b. moving a work platform 84 mounted on a turntable 80 (FIG. 1), which turntable 80 is rotatable on the top of a first tower 28 through a tower aperture 20 in the support member 16 to the desired work position within the furnace 10;

c. moving the work platform 84 from a storage position (not shown in FIG. 1) on the turntable 80, where the work platform 84 passes through the tower aperture 20 in the support member 16, to a work position (FIG. 1) where the work platform 84 extends beyond the turntable 80 to enable a workman to stand on the work platform 84;

d. elevating the refractory material 12 through a refractory material aperture 38 in the first tower 28, a second refractory material aperture 38a in the turntable 80 and a third refractory material aperture 38b in the work platform 84 into alignment with the work platform 84 so that the refractory material 12 can be transferred to the work platform 84 (FIG. 1);

e. transferring the refractory material 12 to the work platform 84;

f. rotating the turntable 80 and the work platform 84 to align the work platform 84 with an inner portion of the furnace 10 where the inner lining 11 of the refractory material 12 is to be applied; and g. applying the refractory material 12 the inner portion of the furnace 10.

In addition, the preferred method includes the following additional steps (either along or in combination) of:

a. guiding the work platform 84, the turntable 80 and the first tower 28 through the bottom aperture 18 in the furnace 10 (FIG. 1);

b. guiding the refractory material 12 through the refractory material aperture 28 in the first tower 28 (FIG. 1);

c. conveying the refractory material 12 from the third refractory material aperture 38*b* in the work platform 84 to the work position (FIG. 1) on the work platform 84 (FIG. 2);

d. supporting the refractory material 12 on a pallet 120 and the pallet 120 on a conveyor section 122, aligning the conveyor section 122 with the work platform 84, and conveying the pallet 120 and the refractory material 12 onto the work platform 84 (FIG. 1);

e. locking the conveyor section 122 to the work platform 84 (FIG. 2);

f. connecting at 52 the first tower 28 to the tower elevating means 34 (FIGS. 4A, 4B);

g. elevating the refractory material 12 above the work platform 84 to eliminate bending by a workman to pick up the refractory material (FIG. 6);

h. receiving the refractory material 12 on a second or bottom work platform 84a on the bottom of the tower 28 (FIG. 7);

i. conveying the single predetermined amount of the refractory material 12, such as a single brick 12a, from the second work platform 84a into alignment with the work platform 84 (FIG. 7);

j. kicking off the refractory brick 12a adjacent the work platform 84 onto such work platform 84 (FIGS. 7 and 8);

k. guiding the refractory material or brick 12*a*, when the refractory brick 12*a* is adjacent the work platform, onto such work platform 84 (FIG. 7);

l. feeding the refractory material 12*a* when the refractory brick 12*a* is adjacent to the work platform 84 to a predetermined position on the work platform 84 (FIG. 7);

m. forming the end of the refractory material 12 on the bottom of the furnace 10 (FIG. 1);

n. locking the support member 16 to the first tower 28 to permit the removal of the connections 52 (FIGS. 4A, 4B) between the tower elevating means 34 and the first tower 28 (FIG. 1);

o. connecting at 37,66,68 a second tower 28*a* to the bottom of the first tower 28 so that the refractory material aperture 38 in the first tower 28 registers with the refractory material aperture 38*c* in the second tower 28*a*, and connecting at 52*a* the second tower 28*a* to the tower elevating means 34 (FIG. 1);

p. mounting another work platform 84 on the turntable 80 adjacent the first work platform 84 (FIGS. 1 and 2);

q. disposing a platform section 156 between the first work platform 84 and the other or second work platform 84 to bridge the space between such work platforms 84 (FIG. 2);

r. elevating the refractory material 12 above the bottom work platform 84*a* to eliminate bending of a workman (not shown) to pick up the refractory material 12 (FIG. 7);

s. feeding the refractory material 12 or 12*a* to the bottom of a refractory material elevating means 118*a* as the first tower 28 is raised by the tower elevating means 34 (FIG. 9);

t. standing on a brick mason stand 204 depending from the work platfrom 84 to eliminate bending of the workman (not shown) to pick up the refractory material 12 or 12*a* (FIGS. 7 and 8); and u. wiping the refractory material 12*a* from the material feeding means 186 (FIG. 8) adjacent the work platform 84 to cause said refractory material 12 or 12*a* to transfer from the material feeding means 186 to the work platform 84 (FIGS. 7,8).

An alternative method of lining the furnace 10 includes the steps of:

a. securing a table support member 206 to the furnace 10 adjacent the top aperture 208 of the furnace 10 (FIG. 11);

b. moving the work platform 84$^{11}$ through the bottom aperture 18 in the furnace 10 to a desired work position within the furnace 10 (FIG. 11);

c. moving the work platform 84$^{11}$ from a dotted line storage position (FIG. 11) so that the work platform 84$^{11}$ passes through the bottom aperture 18 in the furnace 10, to a solid line work position (FIG. 11) where a workman (not shown) is able to stand on the work platform 84;

d. moving the refractory material 12 through a refractory material aperture 38*d* in the work platform 84$^{11}$ into alignment with the work platform 84$^{11}$ so that the refractory material 12 can be transferred to the work platform 84$^{11}$;

e. transferring the refractory material 12 to the work platform 84$^{11}$;

f. rotating the work platform 84$^{11}$ on a turntable 80$^{11}$ on a table support member 206 to align the work platform 84$^{11}$ with an inner portion of the furnace 10 where the inner lining 11 of the refractory material 12 is to be applied; and g. applying the refractory material 12 to the inner portion of the furnace 10 (FIG. 11).

In addition, the alternative method includes the following additional steps (either alone or in combination) of:

a. stabilizing and centering the work platform 84$^{11}$ within the furnace 10 (FIG. 11);

b. moving one portion 104 of the work platform 84$^{11}$ with respect to the other portion 102 of the work platform 84$^{11}$ to provide a predetermined length L for the work platform 84$^{11}$ (FIG. 11);

c. locking the one portion 104 of the work platform 84$^{11}$ (FIG. 11);

d. levelling table support member 206 with respect to the furnace 10 (FIG. 11);

e. guiding the refractory material 12 through the refractory material aperture 38*d* in the work platform 84$^{11}$ (FIG. 2);

f. conveying the refractory material 12 from the refractory material aperture 38*d* in the work platform 84$^{11}$ in a work position on the work platform 84$^{11}$ (FIG. 2);

g. supporting the refractory material 12 on a pallet 120 and the pallet 120 on a conveyor section 122, aligning the conveyor section 122 with the work platform 84$^{11}$, and transferring the refractory material 12 from the conveyor section 122 to the work platform 84$^{11}$ (FIG. 1);

h. locking the conveyor section 122 to the work platform 84$^{11}$ (FIG. 2);

i. connecting (FIGS. 4A, 4B) the work platform 84$^{11}$ to a work platform elevating means 238 at 52b (FIG. 11);

j. elevating the refractory material 12 above the work platform 84$^{11}$ to eliminate bending of a workman (not shown) to pick up the refractory material 12 (FIG. 6);

k. conveying a predetermined amount of the refractory material 12, such as a single brick 12a, into alignment with the work platform 84$^{11}$ (FIG. 7);

l. kicking off the refractory brick from a refractory material elevating means 118a onto the work platform 84$^{11}$ (FIGS. 7 and 8);

m. guiding the refractory material 12*a*, when the refractory brick 12*a* is adjacent the work platform 84$^{11}$, onto the work platform 84$^{11}$ (FIGS. 7 and 8);

n. guiding the work platform 84$^{11}$ through the bottom aperture 18 in the furnace 10 (FIGS. 11 and 12);

o. feeding the refractory material 12 or 12*a*, when such refractory material 12 or 12*a* is adjacent the work platform 84$^{11}$, to a predetermined position on the work platform (FIGS. 7 and 8);

p. forming the end of the refractory material 12 on the bottom of the furnace 10 (FIG. 1);

q. mounting another work platform 84$^{11}$ adjacent the work platform 84$^{11}$ (FIGS. 1 and 2);

r. disposing a platform section 156 between the work platforms 84$^{11}$ to bridge the space between them (FIGS. 1 and 2);

s. bridging the bottom aperture 18 in the furnace 10 to support the work platform 84$^{11}$ during movement of the work platform 84$^{11}$ between the storage position shown in the dotted lines (FIG. 11) and the work position shown in the solid lines of FIG. 11;

t. feeding the refractory material 12 to the bottom of the refractory material elevating means 118*a* (FIG. 9);

u. standing on a brick mason stand 204 depending from the work platform 84$^{11}$ to eliminate bending of a workman (not shown) to pick up the refractory material 12 or 12*a* (FIGS. 7 and 8);

v. wiping the refractory material 12*a* from a material feeding means 186 adjacent the work platform 84$^{11}$ onto such work platform 84$^{11}$ (FIG. 8);

w. securing a tower 28$^{12}$ to the turntable 80$^{12}$ (FIG. 12);

x. sliding the work platform 84$^{12}$ on the tower 28$^{12}$ (FIG. 12);

y. guiding the refractory material 12 through a refractory material aperture 38*f* in the tower 28$^{12}$ (FIG. 2);

z. mounting a work platform elevating means 238$^{12}$ on a work platform elevating mounting means 112 above the furnace 10 (FIG. 12 and 2);

a′. mounting a work platform elevating means 238$^{12}$ on the tower 28$^{12}$ (FIG. 12);

b′. connecting at 52c a work platform elevating means 238$^{12}$ (FIGS. 4A,4B) to the work platform 84$^{12}$ (FIG. 12);

c′. mounting a second work platform 84a on the bottom of the tower 28$^{12}$ for receiving the refractory material 12 (FIG. 7);

d'. connecting a second tower $28a^{12}$ to the bottom of the first tower $28^{12}$ so that a refractory material aperture 38f in the tower $28^{12}$ registers with another refractory material aperture 38g in the tower $28a^{12}$ (FIG. 1); and e'. telescoping the tower $28^{12}$ and the second tower $28a^{12}$ with respect to each other.

SUMMARY OF THE ACHIEVEMENTS OF THE OBJECTS OF THE INVENTION

It will be recognized by those skilled in the art that the objects of this invention have been achieved by providing improved apparatus 14 (FIGS. 1–6,10), $14^7$ (FIGS. 7–9,10), $14^{11}$ (FIGS. 10,11 $14^{12}$ (FIGS. 10,12 and 13) for and methods of lining a furnace 10 (provided with a bottom aperture 18) with an inner lining 11 of a refractory material 12, the apparatus and methods being simple and rugged in construction; capable of a long, maintenance-free operational life; efficient and economical in operation; and capable of reducing the normal down time of the furnace due to the relining of the inner lining 11 thereof with the refractory material 12.

While in accordance with the patent statutes, preferred and alternative embodiments of this invention have been illustrated and described in detail, it is to be particularly understood that the invention is not limited thereto or thereby.

I claim:

1. Apparatus for lining a furnace, provided with a bottom aperture in its bottom and a top aperture in its top, with an inner lining of a refractory material, said apparatus having:

a. a table support member secured to said furnace adjacent said top aperture in said furnace;

b. a turntable rotatable on said table support member and provided with work platform elevating means clearance apertures;

c. a work platform movable through said bottom aperture in said furnace while in a storage position and then further movable from said storage position to a work position to enable a workman to stand on said work platform 1. said work platform being provided with a refractory material aperture;

d. work platform elevating means extending through said table support member, and operatively connected between said turntable and said work platform for moving said work platform through said bottom aperture in said furnace to a desired work position within said furnace;

e. refractory material elevating means on said turntable extending through said table support member, and connectable to said refractory material for moving said refractory material through said refractory material aperture in said work platform so that said refractory material can be transferred from said refractory material elevating means to said work platform.

2. The apparatus recited in claim 1 and having:

a. platform guide means operatively positioned between said inner lining and said work table for effecting guided relative movement between said inner lining and said work table.

3. The apparatus recited in claim 1 wherein:

a. said work platform has an outer portion and an inner portion, said outer portion being extendable with respect to said inner portion to provide a variable predetermined length to said work platform.

4. The apparatus recited in claim 3 and having:

a. work platform locking means connected to said outer portion and said inner portion to secure said outer portion and said inner portion together with said predetermined length.

5. The apparatus recited in claim 1 and having:

a. leveling means associated with said furnace and said table support member for leveling said table support member with respect to said furnace.

6. The apparatus recited in claim 1 and having:

a. guide means on said work platform to guide said refractory material through said refractory material aperture in said work platform.

7. The apparatus recited in claim 1 wherein:

a. said work platform elevating means is mounted on said table support member.

8. The apparatus recited in claim 1 wherein:

a. said work platform elevating means is mounted on said work platform.

9. The apparatus recited in claim 1 and having:

a. conveyor means on said work platform extending from said refractory material aperture in said work platform to a work position on said work platform and for delivering said refractory material from said refractory material aperture in said work platform to said work position on said work platform.

10. The apparatus recited in claim 9 and having:

a. said refractory material carried by a pallet; and b. a conveyor section on said pallet, which conveyor section is alignable with said conveyor means to permit the transfer of said pallet and said refractory material from said conveyor section to said conveyor means.

11. The apparatus recited in claim 10 and having:

a. locking means on one member of said conveyor section and said conveyor means for locking the other member of said conveyor section and said conveyor means to said one member.

12. The apparatus recited in claim 1 and having:

a. connecting means on said work platform elevating means for connecting said work platform elevating means to said work platform.

13. The apparatus recited in claim 1 and having:

a. auxiliary elevating means on said work platform for elevating said refractory material above said work platform to eliminate bending of said workman to pick up said refractory material.

14. The apparatus recited in claim 1 and having:

a. said refractory material elevating means operable to convey a single predetermined amount of said refractory material into alignment with said work platform.

15. The apparatus recited in claim 1 and having:

a. kick-off means mounted on said work platform for removing said refractory material from said refractory material elevating means onto said work platform.

16. The apparatus recited in claim 1 and having:

a. material guide means on said work platform for guiding said refractory material, when said refractory material is adjacent said work platform, onto said work platform.

17. The apparatus recited in claim 1 and having:

a. material feeding means on said work platform movable with respect to said work platform and for feeding said refractory material, when said refractory material is adjacent said work platform, to a predetermined position on said work platform.

18. The apparatus recited in claim 1 and having:

a. form means adjacent said bottom aperture of said furnace for defining the end of said refractory material on the bottom of said furnace.

19. The apparatus recited in claim 1 and having:

a. another work platform mounted adjacent said work platform.

20. The apparatus recited in claim 19 and having:

a. a platform section disposed between said work platform and said other work platform to bridge the space between said work platform and said other work platform.

21. The apparatus recited in claim 1 and having:

a. work platform support means bridging said bottom aperture in said furnace for supporting said work platform during movement of said work platform between said storage position and said work position.

22. The apparatus recited in claim 14 and having:

a. a second material feeding means connected at one end to the bottom of said refractory material elevating means and adapted to feed said refractory material to the bottom of said refractory material elevating means as said work platform is raised by said work platform elevating means.

23. The apparatus recited in claim 17 and having:

a. a brick mason stand depending from said work platform to eliminate bending of said workman to pick up said refractory material.

24. The apparatus recited in claim 1 wherein:

a. said turntable is a thrust bearing which takes thrust in a vertical and horizontal direction.

25. The apparatus recited in claim 17 and having:

a. wiping means on said work platform extending into the rotary path of movement of said refractory material on said material feeding means to engage and cause said refractory material to transfer from said material feeding means onto said work platform.

26. The apparatus recited in claim 1 and having:

a. said table support member provided with a tower aperture;

b. said turntable provided with a second tower aperture;

c. a tower adapted to pass through said tower aperture in said table support member and said second tower aperture in said turntable, provided with a second refractory material aperture and secured to said turntable.

27. The apparatus recited in claim 26 and having:

a. said work platform slidable on said tower.

28. The apparatus recited in claim 26 and having:

a. guide means on said tower to guide said refractory material through said second refractory material aperture in said tower.

29. The apparatus recited in claim 26 wherein:

a. said work platform elevating means is mounted on said tower.

30. The apparatus recited in claim 26 wherein:

a. said work platform elevating means is mounted on said work platform.

31. The apparatus recited in claim 1 and having:

a. connecting means on said work platform elevating means for connecting said work platform elevating means to said tower.

32. The apparatus recited in claim 26 and having:

a. a second work platform on the bottom of said tower for receiving said refractory material.

33. The apparatus recited in claim 26 and having:

a. a second tower provided with another refractory material aperture; and b. said second tower being connected to the bottom of said tower so that said refractory material aperture in said tower registers with said other refractory material aperture in said second tower.

34. The apparatus recited in claim 33 and having:

a. said tower and said second tower being telescopic with respect to each other.

35. The apparatus recited in claim 1 and having:

a. leveling means between said furnace and said table support member for leveling said table support member.

* * * * *